US005191163A

United States Patent [19]

Wallwey et al.

[11] Patent Number: 5,191,163

[45] Date of Patent: Mar. 2, 1993

[54] DEVICE FOR SETTING FUZES IN LARGE-CALIBER SHELLS

[75] Inventors: Erich Wallwey, Vellmar; Siegfried Süss, Niestetal, both of Fed. Rep. of Germany

[73] Assignee: Firma Wegmann & Co. GmbH, Kassel, Fed. Rep. of Germany

[21] Appl. No.: 864,912

[22] Filed: Apr. 3, 1992

[30] Foreign Application Priority Data

Apr. 5, 1991 [DE] Fed. Rep. of Germany ..... 4111002

[51] Int. Cl.[5] ..... F42C 17/02

[52] U.S. Cl. ..... 89/6

[58] Field of Search ..... 89/6, 6.5

[56] References Cited

U.S. PATENT DOCUMENTS

| | | | |
|---|---|---|---|
| 922,813 | 5/1909 | Quisling | 89/6 |
| 1,005,762 | 10/1911 | Ziegenfuss | 89/6 |
| 1,028,924 | 6/1912 | Wilck | 89/6 |
| 1,037,811 | 9/1912 | Voller | 89/6 |
| 1,476,552 | 12/1923 | Streicher | 89/6 |
| 3,824,889 | 7/1974 | Kaiser et al. | 89/6 |

*Primary Examiner*—Stephen C. Bentley

*Attorney, Agent, or Firm*—Sprung Horn Kramer & Woods

[57] ABSTRACT

A device for setting fuzes in large-caliber shells, wherein the fuze is coaxial with the point of the shell and has one section secured stationary to the shell and a second section rotatable around the shell's axis. Each section has a groove in the surface which extends along a plane through the shell's axis. The device has a housing which is essentially round and has a handle extending out of it radially. The housing accommodates two concentric rings. A motor rotates one ring by way of a torque limiter. The second ring can either rotate independently of the first ring or be secured to and rotate along with it. The inner circumference of both rings matches the outer circumference of the fuze. The inner surface of the first ring has a pin that slides radially outward against the force of a spring. The inner surface of the second ring has a stationary radial pin. The pins are positioned to ensure that, when the device is applied to a fuze, the first pin will point toward the stationary section and the second pin toward the rotating section of the fuze.

9 Claims, 2 Drawing Sheets

DEVICE FOR SETTING FUZES IN LARGE-CALIBER SHELLS

BACKGROUND OF THE INVENTION

The invention concerns a device for setting fuzes in large-caliber shells. The fuze is coaxial with the point of the shell. The fuze is in two sections. One section is secured stationary to the shell. The other section rotates around the shell's axis. There is a groove in the surface of each section. The groove extends along a plane through the shell's axis.

What are called time-and-percussion fuzes are known for use with large-caliber shells. Such fuzes ignite the shell not only in response to impact but also subsequent to a prescribed delay. The fuzes are positioned at the point of the shell. They generally have a section secured stationary to the shell and a rotating adjusting section used for manually setting the fuze in terms of ignition time. It has been demonstrated that the existing, manually operated, setting tools are to some extent unsatisfactory, especially when employed in the cramped space inside a military tank of armored howitzer, due to the ergonomics of the shell-magazine compartment.

SUMMARY OF THE INVENTION

The object of the present invention is a device for setting fuzes in large-caliber shells that will allow reliable and precise automatic fuze setting even in cramped spaces.

This object is attained in accordance with the invention with a device characterized as follows. The device's housing is essentially round and has a handle extending out of it radially. The housing accommodates two concentric rings. A motor rotates one ring by way of a torque limiter. The second ring can either rotate independently of the first ring or be secured to and rotate along with it. The inner circumference of both rings matches the outer circumference of the fuze. The inner surface of the first ring has a pin that slides radially outward against the force of a spring. The inner surface of the second ring has a stationary radial pin. The pins are positioned to ensure that, when the device is applied to a fuze, the first pin will point toward the stationary section and the second pin toward the rotating section of the fuze.

The basic concept of the invention is a device that can be positioned over the point of a shell and is accordingly essentially annular, with a motor-powered ring concentrically accommodating another ring that will rotate along with or independently of the first ring. The second ring can be rotated inside the first ring until the angle between the sliding pin and the stationary pin precisely equals the angle between the rotating and stationary sections of the fuze needed for setting it. As will be specified hereinafter with reference to one embodiment, the device is positioned over the shell such that the stationary pin will enter the groove in the rotating section of the fuze subsequent to an appropriate rotation. The motor will then rotate both rings together until the sliding pin, as it travels over the outer surface of the stationary section, snaps into the groove. The rotating section is then rotated precisely the prescribed angle, with the torque limiter preventing the rings from rotating farther. The fuze is now set.

Once the angle between the two pins has been established, the device in accordance with the invention can be used to automatically set any fuze that is to be set for the same interval. Establishing the angle between the two pins can in one particularly practical embodiment be facilitated by embedding an outwardly visible ring with an appropriate angular scale in the first ring and mounting a window with a center line on the second ring such that, when the two rings are rotated separately, the precise angle can be easily read off. The ring with the scale can be replaceable, allowing different scales for different types of fuze.

As will be specified hereinafter, it is easy to illuminate the scale, which is of particular advantage in poorly lighted conditions. It is also easy to adjust the maximal torque allowed by the torque limiter.

One embodiment of the invention will now be described by way of example with reference to the drawings, wherein:

DETAILED DESCRIPTION OF THE INVENTION

Figure 1:
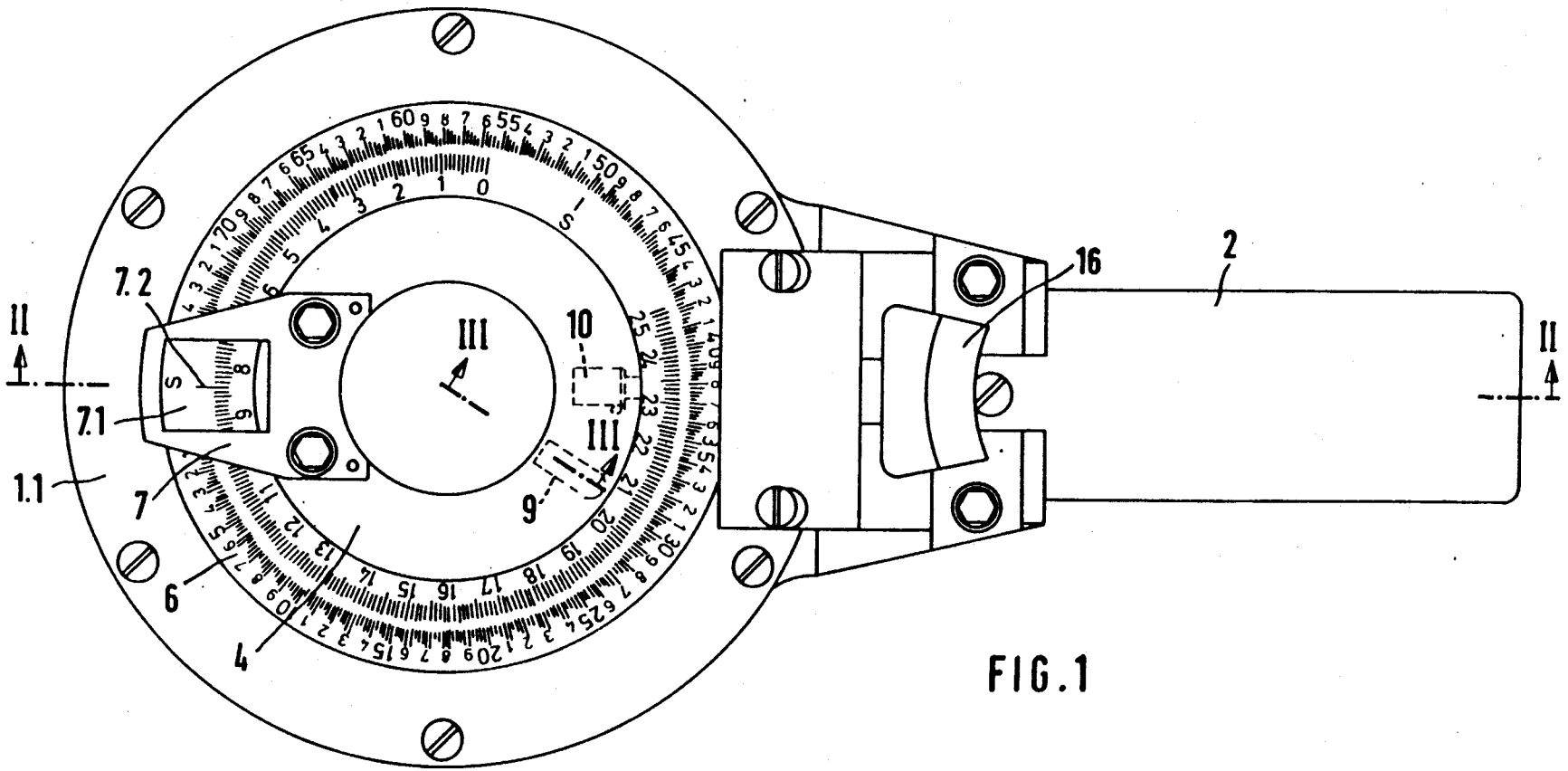
FIG. 1 is a top view of a device for setting fuzes according to the present invention.
Figures 2, 3:
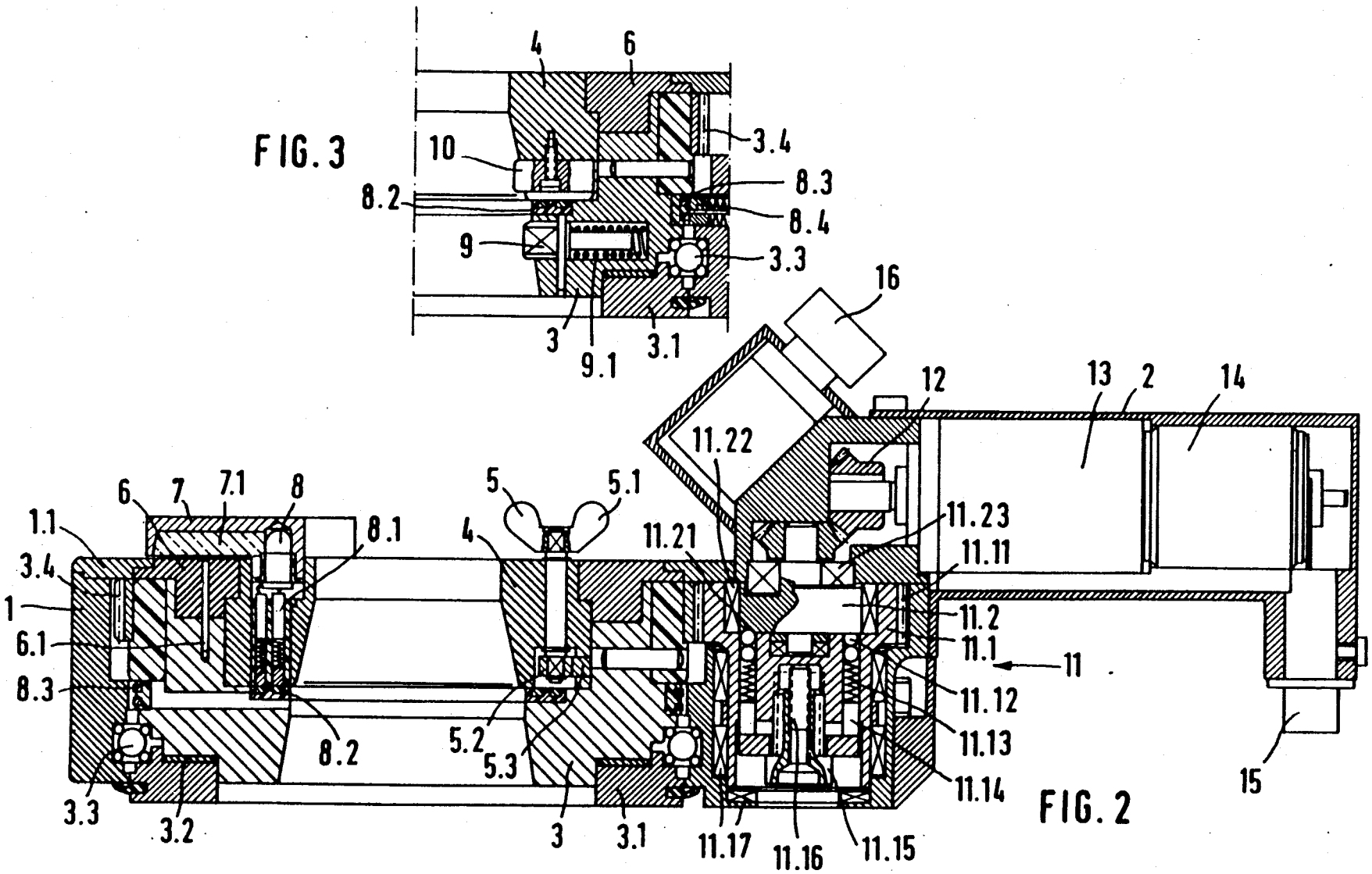
FIG. 2 is a section through the device illustrated in FIG. 1 along the line II—II.
FIG. 3 is a section through part of the device illustrated in FIG. 1 along the line III—III with the stationary pin folded into its plane.

The device for setting fuzes illustrated in FIGS. 1 through 3 has an essentially annular housing 1. Extending radially away from housing 1 is a handle 2. The housing itself accommodates two concentric rings 3 and 4. One ring 3 rotates around a pivot 3.3 and is positioned by an annular retainer 3.1 secured stationary to it and inserted into housing 1 from below as illustrated in FIG. 2. Bearing clearance is adjusted with annular shims 3.2. The other ring 4 fits into the top, as illustrated in FIG. 2, of first ring 3 and rotates separately from it. It can be secured to first ring 3 by means of a tightener 5 by turning a thumbscrew 5.1 that forces a cam 5.2 against a thruster 5.3 accommodated in a rubber ring resting against the inner surface of first ring 3.

"Top" and "bottom" in what follows refer to the top and bottom of the device as illustrated in FIG. 2. The device can of course in principle be employed in any desired orientation. In general it will be positioned over the point of an upright shell in the position represented by the broken lines in FIG. 2. The inner circumferences of rings 3 and 4 match the outer circumference of the fuze at the shell's point.

Second ring 4 is positioned in first ring 3 leaving an arc of each ring accessible at the top of the device, specifically an inner arc from second ring 4 and an outer arc from first ring 3. The outer arc constitutes an annular slide 6. Slide 6 can be replaced. It is secured to first ring 3 by a pin 6.1 and accordingly rotates along with it. It is held in place by a retaining ring 1.1 on housing 1. It has, as will be evident from FIG. 1, a conventionally graduated chronological scale appropriate for the type of fuze being employed.

The scale can be read through a window 7 that has a line 7.2 extending through the middle of a prismatic pane 7.1.

The scale is illuminated in the vicinity of window 7 by a lamp 8 with leads connected to a pair 8.2 of slip rings by way of sliding contacts 8.1. The slip rings are accommodated in a section of the surface of first ring 3 that faces the bottom of second ring 4. Pair 8.2 of slip rings is connected by unillustrated lines to another pair on the surface of first ring 3. The second pair is connected, as will be evident from FIG. 3, by way of sliding contacts 8.4 and unillustrated lines that extend from housing 1, through handle 2, and by way of a switch 16 to a plug 15 at the end of the handle.

A pin 9 that slides radially against the force of a compression spring 9.1 is mounted on the inner surface of first ring 3. With compression spring 9.1 released, pin 9 can be displaced all the way out of first ring 3 against the force of the spring.

Another pin 10 is secured stationary extending into second ring 4 from its inner surface.

As will be evident from FIG. 3, pin 10 is above pin 9, and the two are displaced from each other by the angle between first ring 3 and second ring 4.

FIG. 1 illustrates the position of pin 9 in relation to pin 10. For simplicity's sake, however, pin 10 is not illustrated in FIG. 2, but has been folded into the plane of the line III—III in FIG. 1 and appears in FIG. 3.

A torque limiter 11 engages first ring 3 by way of a crown gear 3.4 on the ring's surface. The teeth in crown gear 3.4 are engaged by teeth 11.11 in the outtake section 11.1 of torque limiter 11. Outtake section 11.1 has bores that accommodate balls 11.12 subject to springs 11.13. The balls couple the outtake section to an intake section 11.2. The coupling between outtake section 11.1 and intake section 11.2 is engaged when springs 11.13 force balls 11.12 into depressions 11.21 in intake section 11.2. When a prescribed torque is exceeded, the balls will be forced out of the depressions and the coupling will be disengaged. The prescribed torque is established by way of a setting component 11.14 that counteracts springs 11.13 and can be adjusted by a screw 11.15 to various settings. The torque setting can be maintained by another screw 11.16. Outtake section 11.1 and intake section 11.2 are accommodated in housing 1 in bearings 11.17, 11.22, and 11.23.

Intake section 11.2 is connected to a motor 14 by a beveled gear 12 and a reducing gear 13. Reducing gear 13 and motor 14 are accommodated inside handle 2. Unillustrated electric lines also extend from plug 15 to motor 14 by way of switch 16, which can be a combination touch and on-and-off switch.

How the device operates and is operated will now be specified.

The appropriate slide 6 for the type of fuze to be set is inserted in first ring 3 and secured by pin 6.1. Plug 15 is connected by cable to the vehicle's power supply.

The fuze's timing is established as will now be described. Tightener 5 is released and second ring 4 rotated in first ring 3 until the line 7.2 in window 7 is above the desired graduation on slide 6. Second ring 4 is secured to first ring 3 by tightening tightener 5. These procedures can if necessary be carried out with lamp 8 turned on at switch 16 (its on-and-off function). Pane 7.1 will deflect the light onto slide 6.

Rotating second ring 4 in first ring 3 will automatically position pins 9 and 10 at the prescribed angle apart.

Torque limiter 11 is set by screw 11.15 to a prescribed maximal torque, between 10 and 15 Nm for example. The setting is maintained by screw 11.16.

With the device adjusted as described it will be possible to set any number of fuzes. The device is for this purpose positioned horizontal as illustrated in FIG. 2 over the top of an upright shell. Switch 16 is activated (in the press-and-release mode) and motor 14 activates first ring 3 by way of reducing gear 13, beveled gear 12, and torque limiter 11. First ring 3 rotates with second ring 4 until pin 10 enters the groove in the rotating upper section of the fuze. This locks the upper section if the fuze to the rotating first ring 3. The device moves down over the shell until the inner circumferences of both rings rest against the outer circumference of the fuze, forcing pin 9, which faces the stationary section of the fuze, out through the fuze's surface. As the rotation continues, the reaction moment minus the moment of friction from first ring 3 must be accommodated by the operator at handle 2.

As first ring 3 continues to rotate, the fuze's rotating upper section rotates by the tensioned stationary pin 10 until the resilient pin 9 snaps into the groove in the fuze's stationary lower section. No further motion is possible, and the fuze is set. The position of the grooves in the fuze corresponds to the position of pins 9 and 10, and the time established in the device will be transferred to the fuze. No rotation can occur at first ring 3 while switch 16 is pressed because both pins are secured in the corresponding grooves in the fuze, and the new torque will be maintained at the specified level by the torque limiter, Excessive torques can accordingly not be transmitted to the fuze.

The setting procedure is now concluded and the device is lifted off to set the next fuze.

It will be appreciated that the instant specifications and claims are set forth by way of illustration and not limitation, and that various modifications and changes may be made without departing from the spirit and scope of the present invention.

What is claimed is:

1. A device for setting a fuze in a large-caliber shell, wherein the fuze is coaxial with the point of the shell and has one section secured stationary to the shell and a second section rotatable around the axis of the shell and a groove in the surface of each section extending along a plane through the axis of the shell, the device comprising: an essentially round housing; a handle extending radially out of the housing; first and second concentric rings, means mounting the first ring for rotation in the housing, means mounting the second ring for rotation independently of the first ring, means for securing the second ring to the first ring for rotation therewith, wherein both rings have an inner surface configured to match the outer surface of a fuze, a motor for rotating the first ring including a torque limiter, and wherein the inner surface of the first ring has a pin mounted for sliding movement radially inwardly against the force of a spring and radially outwardly, the inner surface of the second ring has a stationary radial pin, and the pins are positioned such that, when the device is applied to a fuze, the first pin will point toward the stationary section and the second pin toward the rotating section of the fuze.

2. The device as in claim 1 for fuzes with a rotating section closer than the stationary section to the point of the shell, wherein the rings are accommodated in the housing such that, when the device is positioned over the fuze, the second ring will be between the first ring and the point of the shell.

3. The device as in claim 2, wherein the second ring is positioned coaxially inside the first ring such that, when the device is positioned over the fuze, arcs in the surface of the two rings that faces the point of the shell are positioned one inside the other essentially in a plane perpendicular to the axis of the shell and accessible from outside.

4. The device as in claim 3, wherein the arc on the surface of the first ring surrounds the arc on the surface of the second ring and comprises a slide that is fixed non-rotatably to the first ring.

5. The device as in claim 4, further comprising a window with a line on it and mounted over the slide within a prescribed section of the arc.

6. The device as in claim 5, wherein the window has a prismatic pane with the line on it.

7. The device as in claim 6, whereby the window has a source of electric light with leads extending through a pair of slip rings to electric connecting lines that extend through the first ring and by way of another pair of slip rings to electric supply lines that extend through the housing.

8. The device as in claim 1, wherein the electric motor is in the handle.

9. The device as in claim 1, wherein the torque limiter has means for setting same to the maximal transmittable torque.

* * * * *